US007455001B1

(12) United States Patent
Waters

(10) Patent No.: US 7,455,001 B1
(45) Date of Patent: Nov. 25, 2008

(54) PORTABLE POWER SAW SUPPORT ATTACHMENT

(76) Inventor: Timothy Waters, 14593 Wolfgang Rd., Truckee, CA (US) 96161

( * ) Notice: Subject to any disclaimer, the term of this patent is extended or adjusted under 35 U.S.C. 154(b) by 210 days.

(21) Appl. No.: 11/473,575

(22) Filed: Jun. 22, 2006

(51) Int. Cl.
*B25G 1/01* (2006.01)

(52) U.S. Cl. ..... 81/489; 248/309.1; 16/406; 16/422; 16/426

(58) Field of Classification Search ..... 248/309.1, 248/322, 302, 304, 306; 451/236; 81/177.1, 81/489; 30/296.1, 390, 388; 16/406, 410, 16/413, 422, 426
See application file for complete search history.

(56) References Cited

U.S. PATENT DOCUMENTS

| | | | | |
|---|---|---|---|---|
| 1,303,908 | A | 5/1919 | Johnson | |
| 1,948,932 | A | 2/1934 | McMickle | |
| 2,262,832 | A | 11/1941 | Caldwell | |
| 2,309,990 | A | 2/1943 | Savi | |
| 2,467,905 | A | 4/1949 | Osterberg | |
| 2,730,803 | A | 1/1956 | Kimball | |
| 2,841,192 | A | 1/1958 | Martin | |
| D232,153 | S * | 7/1974 | Pepper | D8/70 |
| 3,886,658 | A | 6/1975 | Wikoff | |
| 4,179,805 | A | 12/1979 | Yamada | |
| 4,406,064 | A | 9/1983 | Goss | |
| 4,787,145 | A | 11/1988 | Klicker | |
| 5,930,903 | A | 8/1999 | Hurn | |
| 7,127,971 | B1 * | 10/2006 | Braun | 81/177.1 |

* cited by examiner

*Primary Examiner*—Amy J. Sterling
(74) *Attorney, Agent, or Firm*—Mark Levy; Hinman, Howard & Kattell

(57) ABSTRACT

A one piece fixed attachment for a portable power saw which replaces the upper handle on a power saw with a handle having a multiple pronged, u-shaped forward extension capable of supporting a saw vertically on end with its trigger handle in an upward position. When attached to a power saw, the saw can be hung over the top edge of rafters, joists, and sawhorses. It can also be used to hang a saw on a variety of level or pitched dimensional and "I beam" shaped materials securely. It is secured to the saw housing by screw fasteners that line up with threaded screw holes in the saw body housing and sawblade housing.

3 Claims, 7 Drawing Sheets

PORTABLE POWER SAW SUPPORT ATTACHMENT

FIELD OF THE INVENTION

The present invention relates to power tools and, more particularly, to a portable power saw support attachment.

BACKGROUND OF THE INVENTION

Over the past two decades the construction industry has seen the introduction and increased usage of manufactured structural building materials. These materials come in various sizes and shapes from narrow laminated strand lumber rim boards to thicker laminated veneer lumber joists and rafters. Also gaining in popularity has been the use of manufactured "I" joist products in rafter and floor systems. These new products, combined with traditional dimensional building materials result in a variety of different shapes and thicknesses of structural materials on today's jobsite.

The addition of the "I beam" shaped joist or rafter has created the need for a versatile new class of portable power tool hanger, capable of hanging on varying shapes and thicknesses of materials. The lack of surface area on the sides of an "I beam" shape makes an ordinary U-shaped hanger prone to slipping when hung on a pitched "I beam". Specifically, what is needed is a hanger for safely hanging the saw over the top of an "I beam" or pitched rafter. The hanger should rotate to lock the tool securely so it will not roll or slide off.

In addition, since the invention of portable power saws in the construction trade, there has been a need to support these tools in a vertical position with their trigger handle elevated to shorten the distance a worker needs to bend over to grip and lift it. Generally, with no table or edge-up supports to hang them on, portable power saws are simply laid on their side on the floor or ground, requiring a user bend over considerably further than if they were furnished with a hanger or support capable of propping them in a vertical, handle-up position. The occurrences of repetitive bending related back injuries in the construction workplace are at least partially due to such saw handling activities.

Refer to U.S. Pat. No. 2,841,192 by Martin. The Martin reference disposes a single forward projecting prong, integrally attached to a portable power saw. This attachment will hang a portable power saw fairly well on a horizontal joist or a shallow pitched rafter using a combination of the forward projecting prong and the saw body housing. However, when hung on "I beam" shaped rafters with greater pitches than those shown in the Martin drawings a lack of contact under the top chord will tend to allow the power saw to slip or roll off creating a potential hazard.

Most other designs limit the capability to hang on only dimensional 2× lumber. No reference shows a single member capable of supporting a portable power saw in a vertical, handle-up position and none address a method of locking a portable power tool onto "I beam" shaped materials securely.

It is therefore the main object of the invention to provide a hanger attachment for a portable power tool that can secure the tool on "I" shaped building materials safely.

It is another object of the invention to provide a single hanger that is capable of securely hanging a saw on varying shapes and thicknesses of both "I" shaped or rectangular materials.

It is another object of the invention to conveniently hang a saw on a joist, rafter or a sawhorse.

It is another object of the invention to provide a support for a portable power saw comprising a forward extending prong of sufficient length, that when used in combination with the saw base table leading edge, triangularly supports a power saw on end with the trigger handle upright.

SUMMARY OF THE INVENTION

In accordance with the present invention, there is provided a one piece fixed attachment for a portable power saw which replaces the upper handle thereof. A handle has a modified unshaped forward extension capable of supporting a saw vertically on end with its trigger handle in an upward position. When attached to a power saw, the saw can be hung over the top edge of rafters, joists, and sawhorses. The attachment can also hang a saw securely from the top edge of varying sizes and shapes of dimensional and "I beam" materials and is secured to the power saw by screw fasteners into threaded holes in the saw body housing.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the Figures.

DESCRIPTION OF THE PREFERRED EMBODIMENT

Figure 1:
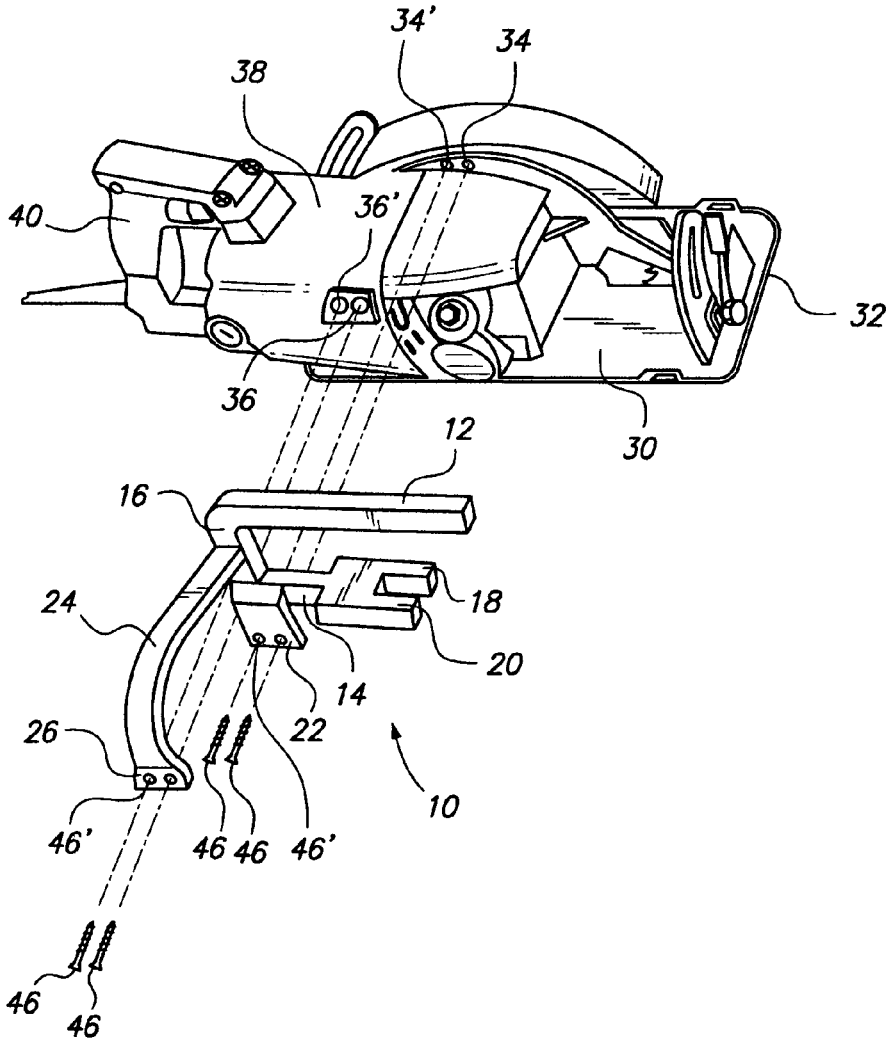
FIG. 1 is a right perspective view of a portable power saw support attachment and portable power saw, in accordance with the present invention.

FIG. 1 shows an exploded perspective view of a portable power saw support attachment 10, a portable power saw 38 and tapered head screw fasteners 46 necessary to fasten the attachment to the portable power saw 38. The upper prong 12 is a forward projecting, horizontal member. The upper prong 12 is attached to a vertical member called the riser 16. The riser 16 has a sawblade housing mounting tab 22 rigidly attached to its right side at the intersection of the riser 16 and a lower prong 14.

A sawblade housing mounting tab 22 overlaps and extends below the bottom of the riser 16, and includes screw holes 46' for receiving tapered head screw fasteners 46 to fasten the portable power saw 38 attachment to threaded holes 34' in the sawblade housing mount 34. The sawblade housing mounting tab 22 serves to provide one of the mounting points for the portable power saw support attachment 10 to the power saw 38. The riser 16 serves as a connection between the upper prong 12 and lower prong 14 to form a unshaped hanger. These three elements, 12, 14, and 16, occupy the same vertical plane when the portable power saw support attachment 10 is mounted on a power saw 38 and the saw is disposed flat on a saw base table 30.

The bottom of the riser 16 is rigidly connected to the lower prong 14. Along both sides of the tip of the lower prong 14 are the left and right tines, 18 and 20, respectively. The tines, 18 and 20 are rigidly sandwiched to both sides of the lower prong 14. The upper prong 12, riser 16, lower prong 14, sawblade housing mounting tab 22, tines 18 and 20, upper handle 24 and saw body housing mounting tab 26 are all made of a lightweight, rigid, impact resistant material.

Attached rigidly to the side of the riser 16 and extending across the top of the portable power saw 38 body is an upper handle 24. On the opposite end of the upper handle 24 is the saw body housing mounting tab 26, which is rigidly attached to the end of the upper handle 24 and has screw holes 46' formed therein to accept tapered head screw fasteners 46 which provide the second and final attachment point between the portable power saw support attachment 10 and two threaded screw holes 46' in the saw body housing mount 36.

The portable power saw support attachment 10 is a molded, fixed shape that consists of all of the above mentioned elements and is fastened to a power saw 38 using tapered head screw fasteners 46.

Figure 2:
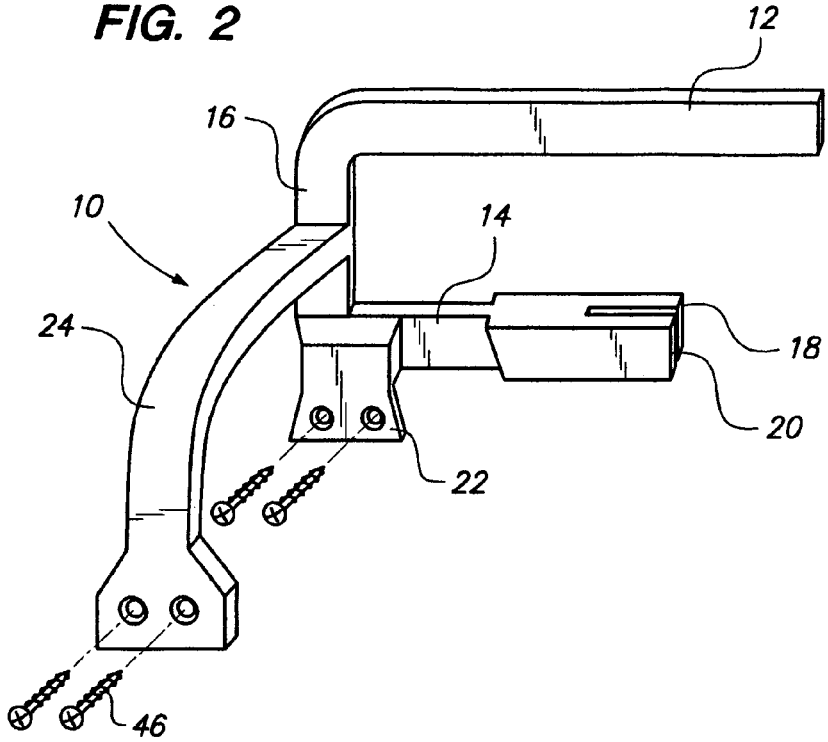
FIG. 2 is a right perspective view of a portable power saw support attachment and four screw fasteners necessary for attachment thereto.

FIG. 2 is a right perspective view of the portable power saw support attachment 10 and the screws necessary for attachment to portable power saw 38.

Figure 3:
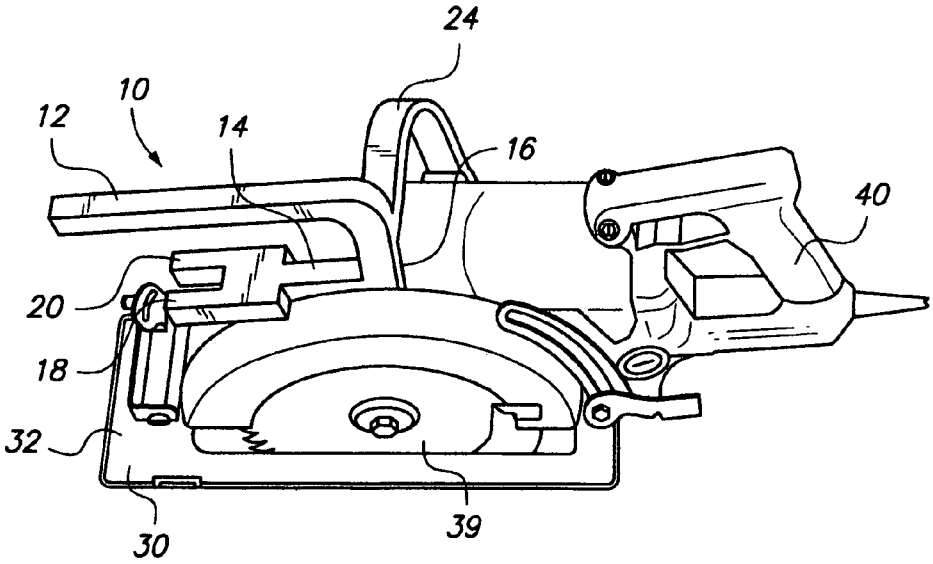
FIG. 3 is a left side, elevated, perspective view view of a portable power saw support attachment mounted on a power saw.

FIG. 3 is a left side high angle perspective view of the portable power saw support attachment 10 mounted on portable power saw 38.

Figure 4:
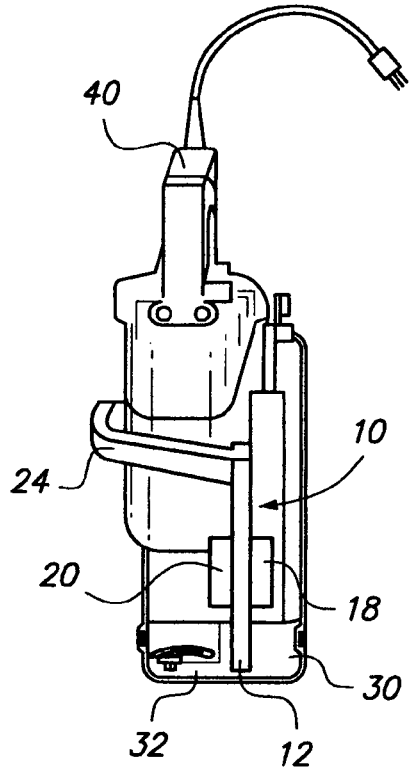
FIG. 4 is a top plan view of a portable power saw support attachment mounted on a power saw.

FIG. 4 is a top plan view of the portable power saw support attachment 10 mounted on portable power saw 38.

Figure 5:
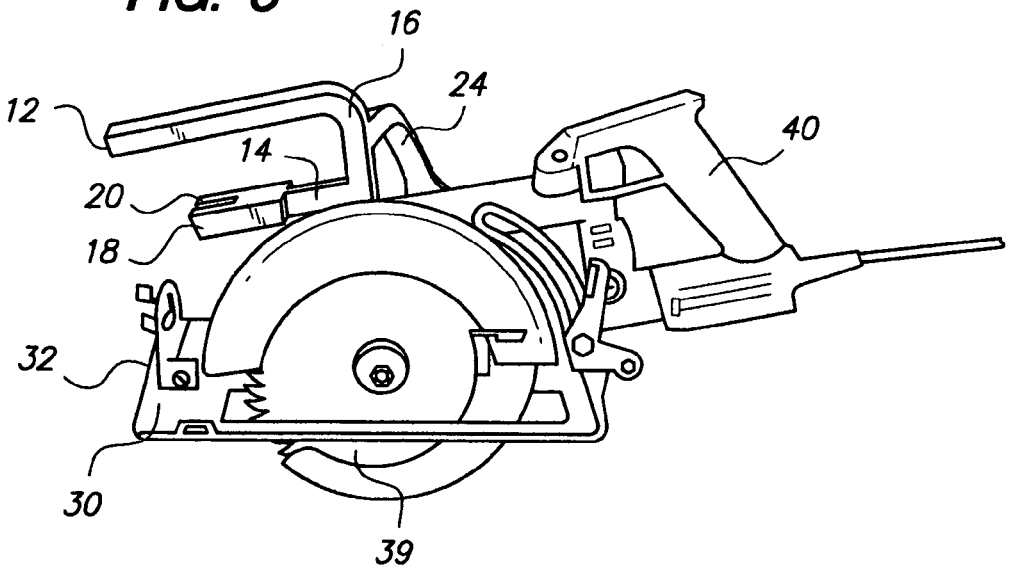
FIG. 5 is a left perspective view of a portable power saw support attachment mounted on a portable power saw showing the saw blade and saw base table set at full cutting depth.

FIG. 5 shows a left side perspective view of the portable power saw support attachment 10. Saw blade 39 and the saw base table 30 set at full cutting depth.

Figure 6:
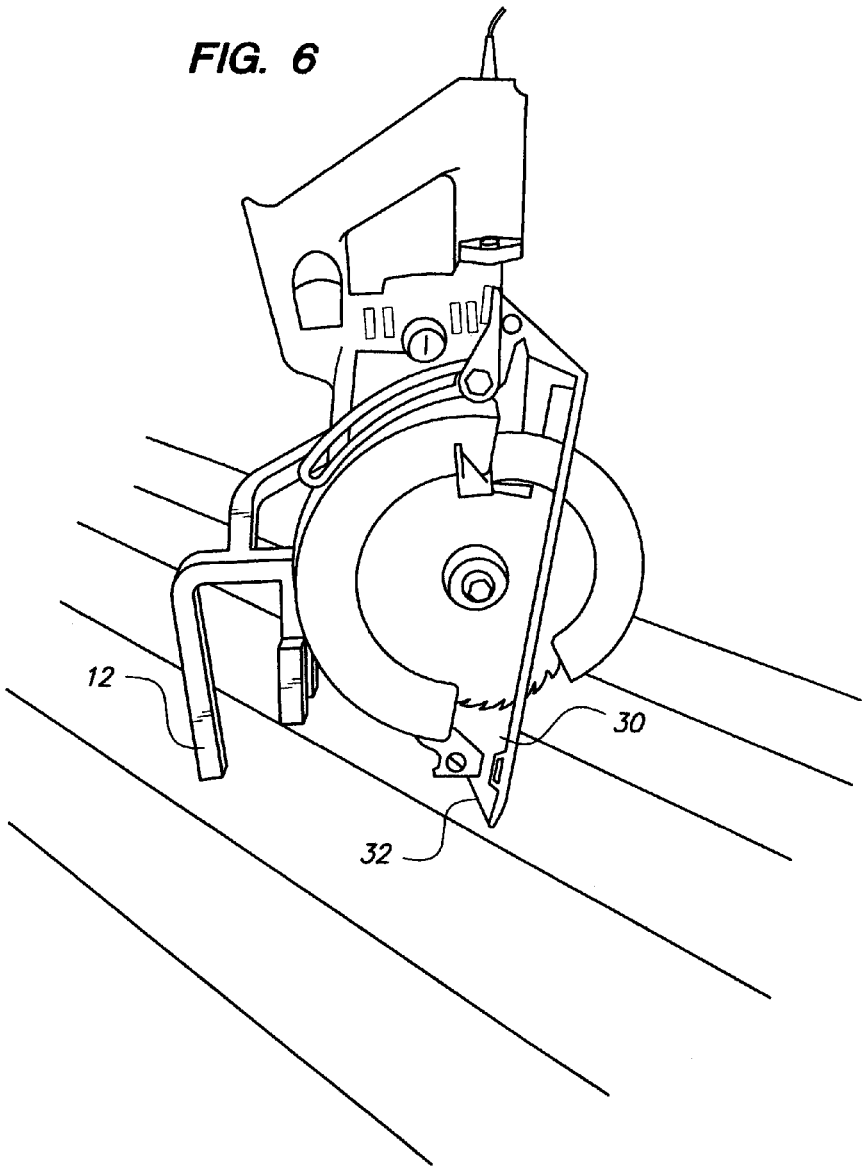
FIG. 6 is a left perspective view of a portable power saw fitted with the portable power saw support attachment supported vertically in a handle-up position on a horizontal surface using a combination of the tip of the upper prong and the leading edge of the saw base table.

FIG. 6 shows a left side perspective view of the portable power saw support attachment 10 balancing a portable power saw 38 on end with the trigger handle 40 in an upright, easy to grip position. The power saw 38 is balanced in this position using a combination of the tip of the upper prong 12 and the leading edge 32 32 of the saw base table 30.

Figure 7:
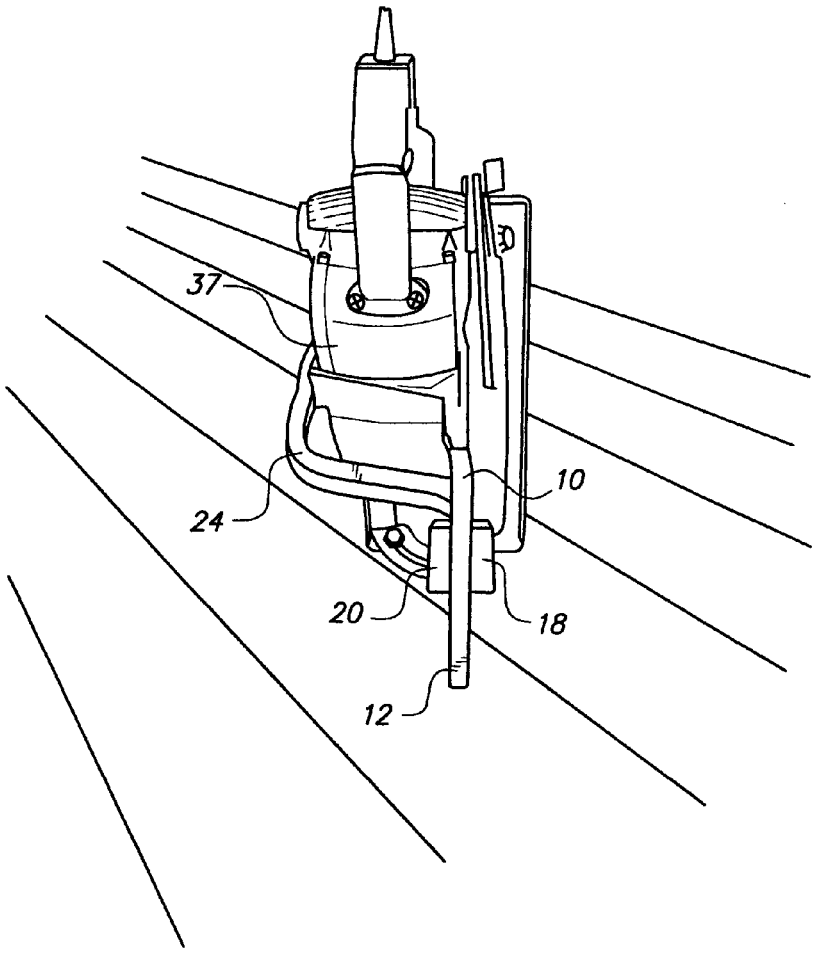
FIG. 7 is a front view of a portable power saw supported vertically in a handle-up position on a floor surface balancing on a combination of the tip of the upper prong and the saw base table leading edge.

FIG. 7 shows a front view of the portable power saw 38 as shown supported in FIG. 6.

Figure 8:
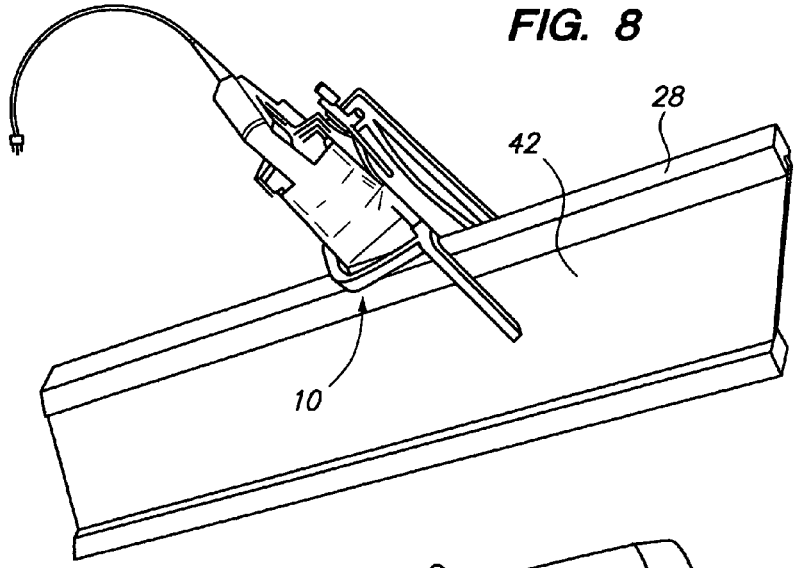
FIG. 8 is a front view of a portable power saw support attachment anchored over the top chord of a truss joist "I beam" rafter and shows the truss joist "I beam" disposed in a pitched position.

FIG. 8 shows a portable power saw 38 hooked on a pitched truss joist "I beam" 42 rafter. This figure also shows the location of the top chord of the truss joist "I beam" 28 or rafter.

Figure 9:
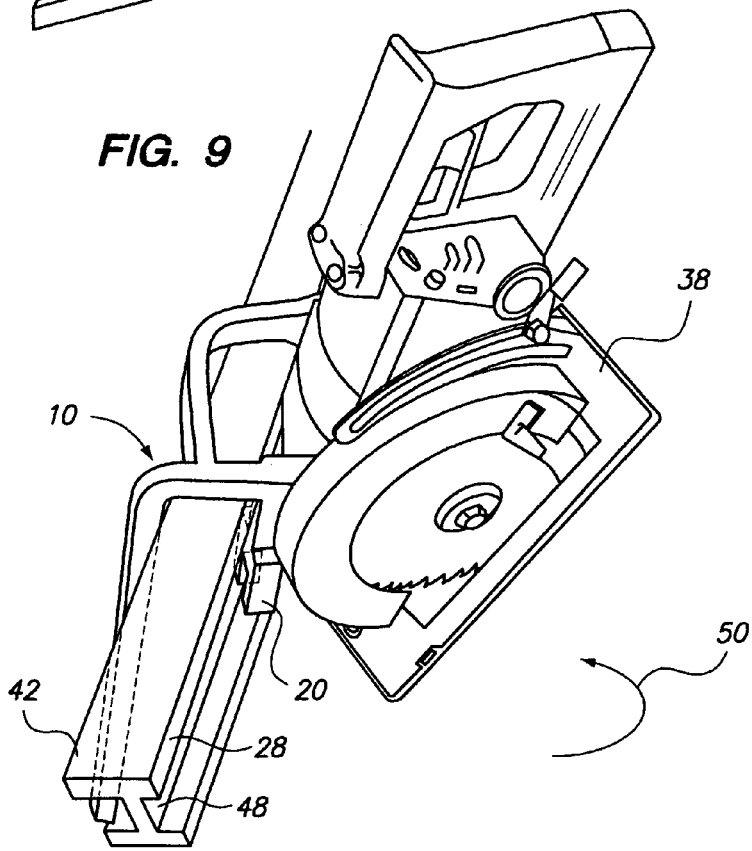
FIG. 9 is a perspective view of a portable power saw shown in FIG. 8 anchored over the top edge of a truss joist "I beam"

FIG. 9 shows a high angle perspective view of the same saw shown in FIG. 8 hooked over the top of a truss joist "I beam" 42. The arrow 50 shown illustrates how the power saw 38, when fitted with the attachment, will rotate generally counterclockwise when the user's grip is released and how the right tine 20 in this case will lock against the center web 48 and underneath the top chord of the truss joist "I beam" 28. This will position the trigger handle 40 in an easy to grip, upright position.

Figure 10:
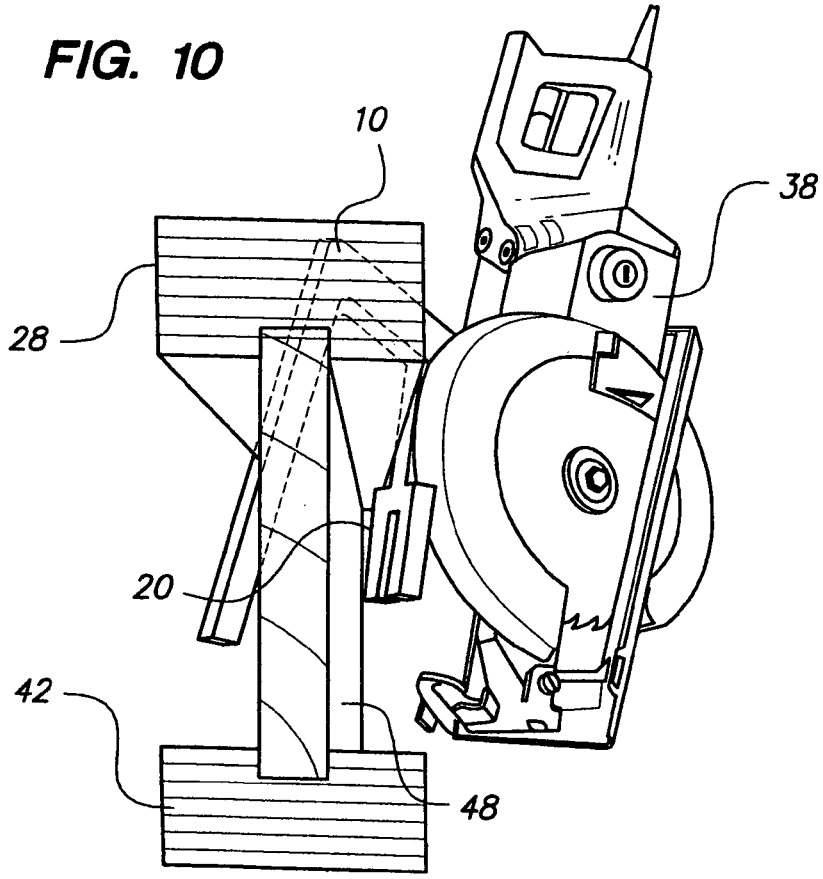
FIG. 10 is a cross sectional view of a truss joist "I beam" with the right tine thereof locked underneath the top chord of the truss joist "I beam" and against the center web to secure a power saw.

FIG. 10 shows a cross sectional view of a truss joist "I beam" 42 and how the right tine 20 is locked underneath the top chord of the truss joist "I beam" 28 and against the center web 48 to secure the power saw 38.

Figure 11:
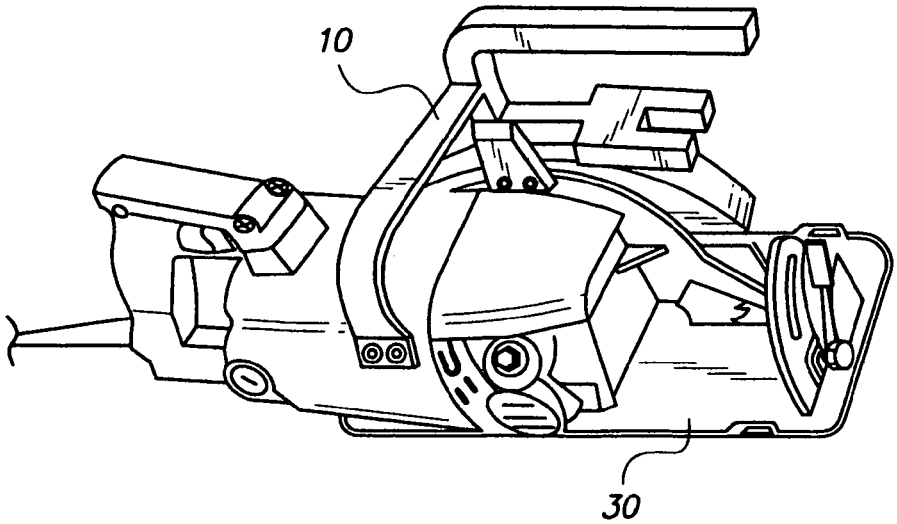
FIG. 11 is a right perspective view of a portable power saw sitting flat on its saw base table with the portable power saw support attachment installed.

FIG. 11 is a right side perspective view of a portable power saw 38 sitting flat on its saw base table 30 with the portable power saw support attachment 10 installed.

In operation, when the portable power saw support attachment 10 is fastened to a power saw 38, a user simply needs to grip the power saw 38 by the trigger handle 40, lift the power saw 38 and position the upper and lower prongs, 12 and 14, over the top edge of the chosen structural support, be it a rafter, joist or sawhorse. The saw is lowered until the riser 16 of the portable power saw support attachment 10 makes contact with the top edge of the structural support. The user releases his grip on the trigger handle 40 and allows the power saw 38 to rotate one of the tines 18, 20, into the center web 48 and underneath the top chord of the truss joist "I beam" 28 allowing the weight of the power saw 38 to rest upon the leading edge 32 of the upper handle 24. This secure position is illustrated in FIGS. 8 and 9 over the top edge of a truss joist "I beam".

When the portable power saw support attachment 10 is viewed from the side as in FIG. 5, the shape between the upper prong 12 and lower prong 14 is rectangular. When viewed perspectively, or rotated, as in FIG. 3, the shape between the upper prong 12 and lower prong 14 of the support attachment appears as an "L" shape capable of locking a power saw 38 onto a truss joist "I beam" securely. These varying shapes give the attachment the ability to hang the power saw 38 securely on a variety of either "I" shaped or rectangular or dimensional materials, such as the commonly used 2× materials. The tip of the upper prong 12 when used in combination with the leading edge 32 of the saw base table 30 forms a triangle capable of supporting a power saw 38 vertically on end with the main trigger handle 40 in an upright position, decreasing the distance one has to bend over by about 12 inches to pick up an approximately 16 pound portable power saw 38.

In operation, FIGS. 8, 9 and 10 show the support attachment hooked over the top of a truss joist "I beam" while FIGS. 6 and 7 show the tip of the support attachment creating a vertical prop for the power saw 38 to facilitate a grip on the trigger handle 40 for ease of lifting decreasing the amount a worker has to bend over to rest or lift a portable power saw 38. This becomes important when one has to repetitively bend over to pick up a cutting tool. This feature effectively can reduce the amount one has to bend over by about 12 inches. FIG. 6 shows the capability of supporting a portable power saw 38 on edge on a relatively level surface using the tip of the upper prong 12 and the saw base table 30 leading edge 32. It should also be noted that a portable power saw 38 should never be left in this position with the sawblade in rotation for safety sake.

FIG. 7 shows the same vertical support and also the location of the upper prong 12, left tine 18, right tine 20 and upper handle 24 in respect to the sawblade housing.

FIG. 8 shows power saw 38 on a truss joist "I beam" 42 using the inside of the u-shape and the front edge of the upper handle 24 without using the saw body housing 37 as a support mechanism.

FIG. 9 shows one of the tines 18, 20 rotated underneath the top chord of truss joist "I beam" 42 locking the attachment securely to prevent slippage.

FIG. 10 shows an arrow 50 displaying the natural rotation of the power saw 38 into a locking position on truss joist "I beam" created when the user's grip is released. The offset location of the u-shaped hanger in relation to the center of gravity of the power saw 38 facilitates this rotation.

FIG. 10 also shows a cross sectional view of a truss joist "I beam" 42 and power saw 38 support attachment, hung and rotated, illustrating how one of the tines 18,20, locks beneath the top chord of the truss joist "I beam" 28 and against the center web 48 unlike any other hanger of the prior art.

In the preferred embodiment all members of the portable power saw support attachment 10 consist of rectangularly shaped materials. However, these members could consist of cross sectionally round or oval shaped materials so this attachment can be adapted to fit and be used on other types of hand and power tools.

It should also be understood that other embodiments of the portable power tool support attachment can exchange the location and lengths of the upper prong 12 and lower prong 14. In such embodiments the lower prong 14 in combination with its left and right tines 18,20 would occupy the position and forward projecting length of the upper prong 12 as shown in the preferred embodiment. The upper prong 12 would occupy the position and forward projecting length of the lower prong 14 in combination with its left and right tines as shown in the preferred embodiment.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A portable power saw support attachment for hanging a portable saw having a handle, a saw blade and a saw base table, ergonomically, from building structures, comprising:

an upper prong, having a tip of sufficient length to support a portable power saw on end when used in conjunction with the leading edge of the saw base table, for supporting the portable power saw in a vertical position when used in conjunction with the leading edge of the saw base table;

a lower prong, for sandwiching two forward extending tines;

a riser, for connecting the upper and lower prongs to form a U-shaped hanger and to provide an attachment point for the handle, rigidly connected to said lower prong, and rigidly connected to said upper prong;

a left tine, for sandwiching against the lower prong to form a block capable of locking against a center web and underneath a top chord of a truss joist "I beam", rigidly connected to said lower prong;

a right tine, for sandwiching against the lower prong to form a block capable of locking against the center web and underneath the top chord of a truss joist "I beam", rigidly connected to said lower prong;

a sawblade housing mounting tab, for creating an attachment point for the hanger to a sawblade housing;

for being rigidly attached to a handle saw body housing mounting tab, for providing a second mounting point to a saw body for the support attachment.

2. The portable power saw support attachment as recited in claim 1, further comprising:

a horizontal extension from the riser that turns downward toward the saw body on the right side when viewed from above, rigidly connects to the riser to form a brace, rigidly connects to the saw body housing mounting tab upper handle, for bracing for the U-shaped hanger, rigidly connected to said riser, and rigidly connected to said saw body housing mounting tab.

3. A portable power saw support attachment for hanging a portable saw having a handle, a saw blade and a saw base table, ergonomically, from building structures, comprising:

an upper prong, having a tip of sufficient length to support a portable power saw on end when used in conjunction with the leading edge of the saw base table, for supporting the portable power saw in a vertical position when used in conjunction with the leading edge of the saw base table;

a lower prong, for sandwiching two forward extending tines;

a riser, for connecting the upper and lower prongs to form a U-shaped hanger and to provide an attachment point for the handle, rigidly connected to said lower prong, and rigidly connected to said upper prong;

a left tine, for sandwiching against the lower prong to form a block capable of locking against a center web and underneath a top chord of a truss joist "I beam", rigidly connected to said lower prong;

a right tine, for sandwiching against the lower prong to form a block capable of locking against the center web and underneath the top chord of a truss joist "I beam", rigidly connected to said lower prong;

a sawblade housing mounting tab, for creating an attachment point for a hanger to the sawblade housing;

a horizontal extension from the riser that turns downward toward a saw body on a right side when viewed from above, rigidly connects to the riser to form a brace, rigidly connects to a saw body housing mounting tab upper handle, for bracing for the U-shaped hanger, rigidly connected to said riser;

for being rigidly attached to the handle saw body housing mounting tab, for providing a second mounting point to the saw body for the support attachment, rigidly connected to said upper handle.

* * * * *